1/24/84 XR 4,427,394

United States Patent [19]

Felter

[11] 4,427,394

[45] Jan. 24, 1984

[54] APPARATUS TO BE TOWED THROUGH THE WATER

[76] Inventor: Mark R. Felter, 2626 Indian Hill Rd., Cedar Rapids, Iowa 52403

[21] Appl. No.: 309,211

[22] Filed: Oct. 7, 1981

[51] Int. Cl.[3] ..... B63C 9/16

[52] U.S. Cl. ..... 441/66; 441/131; 114/253

[58] Field of Search ..... 441/43, 65, 66, 67, 441/72, 81, 129–131; 114/251, 253, 363; 440/34

[56] References Cited

U.S. PATENT DOCUMENTS

| | | | |
|---|---|---|---|
| 378,171 | 2/1888 | McCarthy . | |
| 526,126 | 9/1894 | Ericson . | |
| 1,190,743 | 7/1916 | Fageol | 441/131 |
| 1,764,852 | 6/1930 | Phillips | 441/131 |
| 2,075,374 | 3/1937 | Tucker | 441/131 |
| 2,173,963 | 9/1939 | Eubank | 441/131 |
| 3,074,084 | 1/1963 | Bisch | 441/131 |
| 3,080,584 | 3/1963 | Brown . | |
| 3,135,978 | 6/1964 | Grasmoen . | |
| 3,145,400 | 8/1964 | Yoakum . | |
| 3,435,471 | 4/1969 | Drennen, Jr. . | |
| 3,528,116 | 9/1970 | Fenar . | |
| 3,581,328 | 6/1971 | Smith . | |
| 4,030,151 | 6/1977 | McKeen | 441/66 |
| 4,160,299 | 7/1979 | Hilbern | 441/131 |

*Primary Examiner*—Trygve M. Blix
*Assistant Examiner*—Stephen P. Avila
*Attorney, Agent, or Firm*—Hill, Van Santen, Steadman & Simpson

[57] ABSTRACT

A water sport apparatus which can be attached to an inner tube and includes a flexible seat that can be strapped to the inner tube and a pair of extending portions that pass over the inner tube and are connected to a tow line.

1 Claim, 5 Drawing Figures

FIG. 1
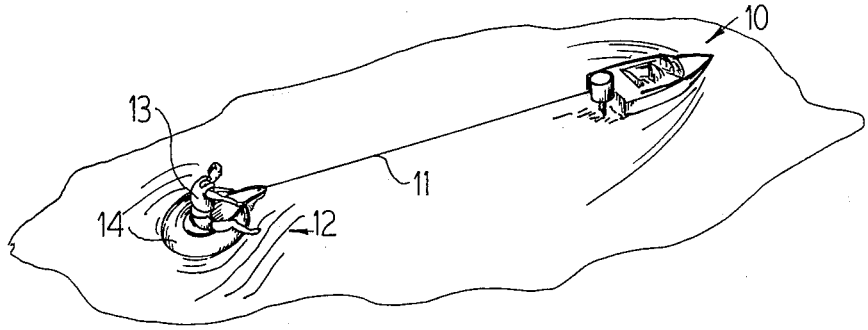
FIG. 2
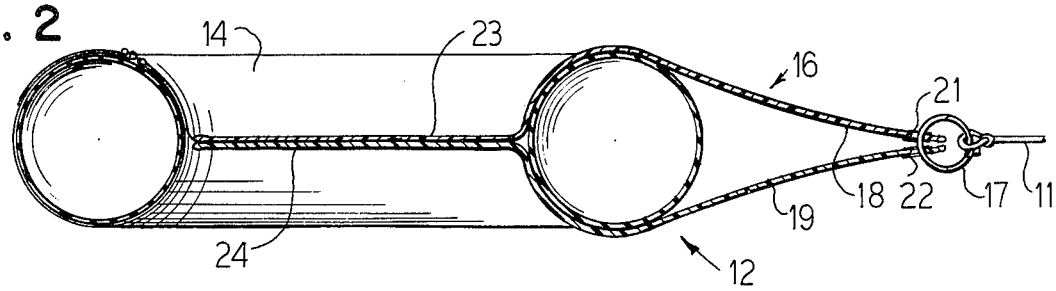
FIG. 3
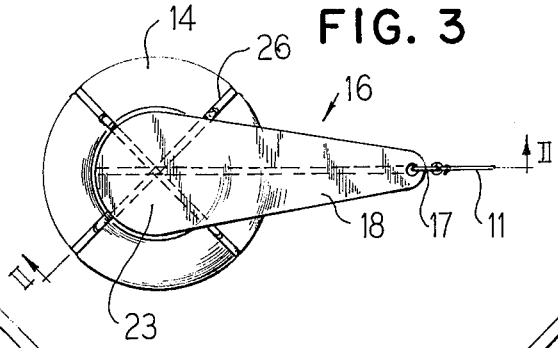
FIG. 4
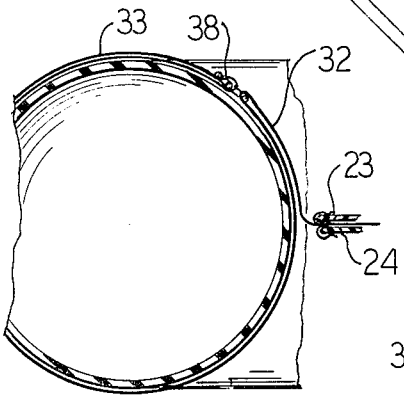
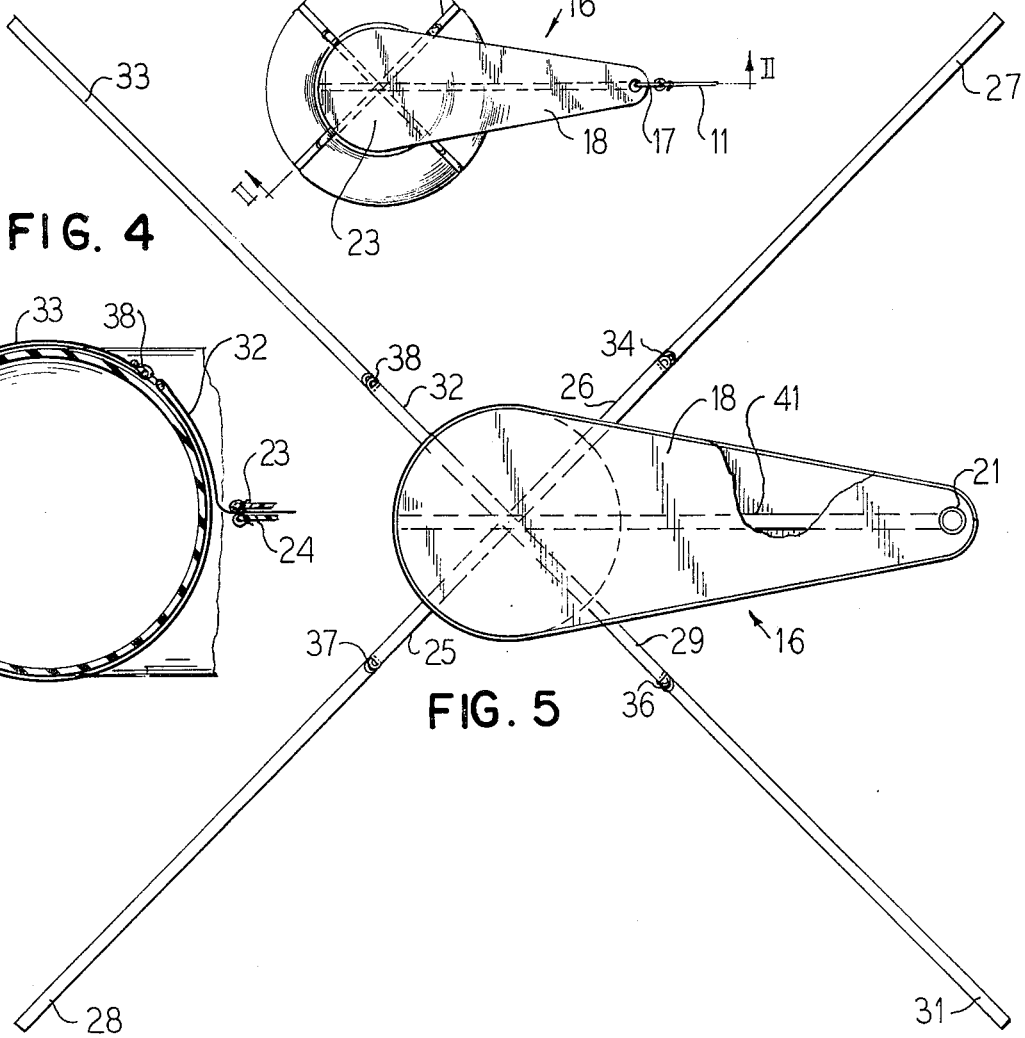
FIG. 5

APPARATUS TO BE TOWED THROUGH THE WATER

BACKGROUND OF THE INVENTION

1. Field of the Invention

This invention relates in general to apparatus which is to be towed through the water behind a boat and in particular to a combination inner tube and attaching device which can be mounted on the inner tube and pulled by a suitable towrope.

2. Description of the Prior Art

It is common to utilize water skis wherein the user mounts the skis on his feet and is pulled behind a boat by a towrope. It is also known to utilize a surfboard which is towed behind a boat upon which a person can stand or sit.

SUMMARY OF THE INVENTION

The present invention relates to a novel water sport device comprising an arrangement of fabric that can be mounted to an inner tube so as to provide a seat in the center opening of the inner tube and having a pair of portions which extend around the inner tube and which are joined so as to allow a tow ring to be provided for attaching a towrope. The user can sit or stand in the inner tube with his legs extending over the inner tube and can be towed by the boat.

Other objects, features and advantages of the invention will be readily apparent from the following description of certain preferred embodiments thereof taken in conjunction with the accompanying drawings although variations in modifications may be effected without departing from the spirit and scope of the novel concepts of the disclosure and in which

BRIEF DESCRIPTION OF THE DRAWINGS

FIG. 1 illustrates the invention in use being towed by a boat.

FIG. 2 is a sectional view through the invention.

FIG. 3 is a top plan view of the invention.

FIG. 4 is a sectional view of the invention, and

FIG. 5 is a top plan view of the invention before it is mounted on the inner tube.

DESCRIPTION OF THE PREFERRED EMBODIMENTS

FIG. 1 illustrates a powerboat 10 which has a tow line 11 which is connected to the water sports device 12 of the invention which comprises an inner tube 14 and the novel plastic attachment 16 which is connected to the inner tube. As is shown in FIG. 2 the plastic attachment 16 comprises a pair of flexible plastic extending members 18 and 19 which have grommets 21 and 22 mounted in their outer ends through which a connecting ring 17 extends to connect them to the tow line 11. The portion 18 passes up over the top of the inner tube 14 and the portion 19 passes under the inner tube and the two portions are joined to form seats portions 23 and 24 in the center opening of the inner tube. Straps 26, 25, 29 and 32 are attached to the seat portions 23 and 24 as shown in FIG. 5 and are provided with a buckles 34, 36, 37 and 38 to allow the ends 27, 28, 31 and 33 of the straps to pass around the inner tube so as to firmly attach the flexible member 16 to the inner tube as shown in FIGS. 2, 3 and 4. A reinforcing strap 41 may extend through the portion 18 and to the rear edge of the seat between the members 23 and 24 and a corresponding strap (not shown) may pass through the member 19.

In operation, the straps 26, 25, 29 and 32 are connected to the inner tube with the buckles 34, 36, 37 and 38 and the user sits as shown in FIG. 1 on the seat portion 23 and 24 as the device is towed through the water by the boat 10. The front of the inner tube relative to the direction of movement rides up over the water so that the device skims across the top of the water during use. The operator 13 may lean so as to cause the device 12 to move sideways relative to the boat if desired.

It is to be noted that the ends of members 18 and 19 are joined at a substantial distance from the inner tube as shown in FIG. 2 which provides a desirable towing arrangement.

It is seen that the present invention provides a novel water sport device and although it has been described with respect to preferred embodiments, it is not to be so limited as changes modification may be made therein which are within the full intended scope as defined by the appended claims.

I claim as my invention:

1. A water sport device adapted to be mounted on an inner tube comprising, a seat portion of plastic material, attaching means connecting said seat portion to said inner tube and extending over the center opening thereof, a pair of extending portions of plastic material attached to said seat portion and extending in opposite directions over said inner tube from said seat portion and with their outer ends joined together at a substantial distance from said inner tube and on the outside of the inner tube, and tow grommets mounted therein, a tow line connectable to the outer ends of said pair of extending portions at said tow grommets, wherein said attaching means comprises four straps attached to said seat portion and pass around said inner tube to attach said seat portion to said inner tube and are X-shaped, wherein said attaching means includes four buckles respectively mounted on said four straps for attaching said straps to said inner tube, wherein a first two of said four straps are joined end to end, wherein a second two of said straps are joined end to end and including a third pair of straps which reinforce said extending portions and extend from said tow grommets in said outer ends and pass all the way through the seat and through the X formed by said other four straps and all the way through the seat and back to said tow grommets.

* * * * *